US005852282A

United States Patent [19]

Moore et al.

[11] Patent Number: 5,852,282

[45] Date of Patent: Dec. 22, 1998

[54] SPIDER BRACKET ASSEMBLY

[75] Inventors: Mark Moore, Fayette County; Stacy Springer; Randall Markum, both of Lamar County, all of Ala.; Ryan Taylor, Lowndes County, Miss.

[73] Assignee: Emerson Electric Co., St. Louis, Mo.

[21] Appl. No.: 818,426

[22] Filed: Mar. 17, 1997

[51] Int. Cl.[6] ..... H05B 3/68

[52] U.S. Cl. ..... 219/467; 219/458

[58] Field of Search ..... 219/451, 458, 219/463, 465, 467

[56] References Cited

U.S. PATENT DOCUMENTS

| | | | |
|---|---|---|---|
| 2,938,989 | 5/1960 | Smith . | |
| 3,350,674 | 10/1967 | Kozbelt et al. | 219/467 |
| 3,781,757 | 12/1973 | Barnes | 219/467 |
| 4,388,518 | 6/1983 | Willbanks et al. . | |
| 5,153,414 | 10/1992 | Wilson et al. . | |
| 5,227,611 | 7/1993 | Allatt et al. | 219/458 |

*Primary Examiner*—Teresa Walberg
*Assistant Examiner*—Sam Paik
*Attorney, Agent, or Firm*—Polster, Lieder, Woodruff & Lucchesi

[57] ABSTRACT

A spider bracket (10) supporting an electrical heating element (H) having respective ends (E1, E2) connected in an electrical circuit. The spider bracket has a plurality of arms (12–18) supporting the heating element. These ends are affixed to an electrical wiring support bracket (20) which includes a bracket arm (22) attached to a spider arm (12) and extending therefrom. A holding fixture (24) connects to the bracket arm and includes separate apertures (26, 28) through which each of which a respective end of the heating element is inserted. The fixture also includes a separate, spaced slot (30) in which one of the heating element ends is also inserted. Each aperture has a circumferential rim (**26*r*, 28*r***) projecting outwardly from the fixture and extending circumferentially about the aperture. The rims is deformable, by staking or swaging, for a portion of the rim to be pressed into contact with an end of the heating element. This affixes the end of the heating element to the wiring support bracket.

16 Claims, 2 Drawing Sheets

SPIDER BRACKET ASSEMBLY

BACKGROUND OF THE INVENTION

This invention relates to a spider bracket for supporting an electrical heating element in place on a cook top or the like, and more particularly, to a spider bracket having a wiring support fixture which readily and reliably supports the respective ends of the heating element in place during assembly.

Spider brackets for supporting one or more electrical heating elements are well-known in the art. See, for example, U.S. Pat. Nos. 5,153,414 and 4,388,518 (both of which are for a one heating element construction) and U.S. Pat. No. 2,938,989 (for a two heating element construction). A spider bracket, regardless of the number of heating elements employed, serves two functions. First, the spider bracket must support the heating element(s) in a defined plane so there is a proper distribution of heat to a utensil set upon the heating element. Second, the spider bracket must engage the ends of the heating element(s) so that they are properly located and oriented for connection into an electrical circuit by which current flows through the heating element.

As shown and described in the above referenced patents, there are a variety of methods by which engagement of the ends of the heating element has been attempted. Each has its drawbacks. In the '414 patent, for example, the ends of the heating element are fitted into crimping members which are then deformed about the heating element. Too much crimping pressure can damage the heating element causing an early failure. Too little pressure and the heating element ends can be moved back or forth making it difficult to install the heating element.

In the '518 patent, the ends of the heating element fit through an opening in a grounding bracket which is a separate piece from the remainder of the spider bracket assembly, and with one of the ends also being inserted through a sleeve depending from a main portion of the spider bracket. One of the openings also includes a boss which is crimped against the end of the heating element extending through it. The formation of a sleeve adds cost to the spider bracket assembly as does the provision of the separate grounding bracket. The problem with crimping has already been discussed.

The '989 patent describes a two element construction in which each end of each heating element is first inserted into a slot the sides of which are subsequently crimped about the end, and then through an aperture. Such a construction, even if only for a one element design, is again expensive, and also has the problem associated with crimping.

BRIEF SUMMARY OF THE INVENTION

Among the several objects of the present invention may be noted the provision of a spider bracket assembly for use with an electrical heating element installed in a cook top;

- the provision of such an assembly to define a planar surface upon which the heating element is supported and which maintains a flat surface while the heating element is under a load due to a pot, pan, or other cooking utensil being set upon the heating element;
- the provision of such an assembly to further include a wiring support bracket to which the ends of the heating element are affixed for holding the terminal ends in a preferred position for connecting the heating element into an electrical circuit;

- the provision of such an assembly in which the terminal ends are affixed to the wiring support bracket by swaging or staking;
- the provision of such an assembly in which welding of assembly components is eliminated;
- the provision of such an assembly in which the wiring support bracket is a unitary, integrally formed unit in which each end of the heating element is inserted in an aperture formed in the bracket to support the ends of the heating element in place, and one the ends of the heating element is fitted into a second support formed in the bracket and spaced from the apertures;
- the provision of such an assembly which is easy to assemble, upon which a heating element is readily installed, and to which the terminal ends of the heating element are easily attached by a swaging or staking operation; and,
- the provision of such an assembly which is available in different sizes to accommodate different sized heating elements used with various cook tops.

In accordance with the invention, generally stated, a spider bracket supports an electrical heating element for a cook top or the like. The heating element has respective first and second ends connected in an electrical circuit for current flow through the heating element. The spider bracket has a plurality of arms which support the heating element. The ends of the heating element are affixed to an electrical wiring support bracket. This bracket includes a bracket arm attached to one of the spider arms and extends therefrom. The bracket further includes a holding fixture connected to the bracket arm. This fixture includes separate apertures through each of which a respective end of the heating element is inserted. The fixture also includes a separate, spaced slot in which one of the ends of the heating element is also inserted. Each aperture has a circumferential rim projecting outwardly from the portion of the figure in which the apertures are formed and extending circumferentially about the aperture. Each rim is deformable during a staking or swaging operation for a portion of the rim to be pressed into contact with an end of the heating element to affix the end of the heating element to the wiring support bracket. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
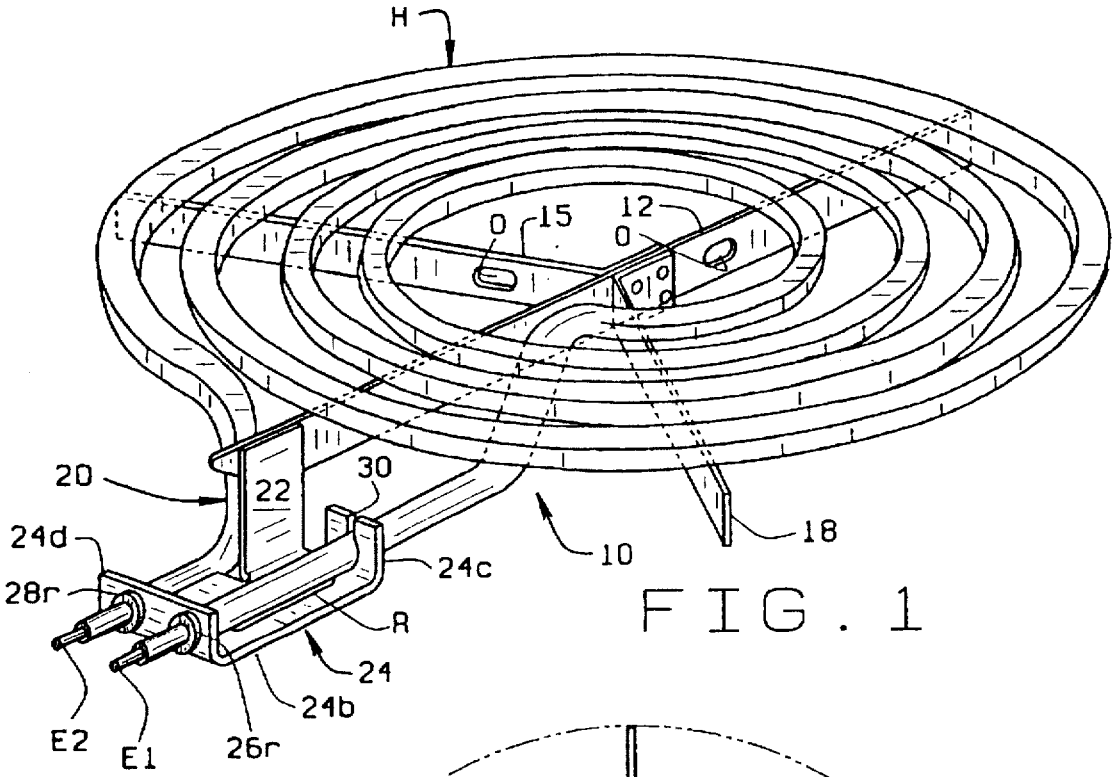
FIG. 1 is a perspective view of a spider bracket assembly of the present invention.
Figure 2:
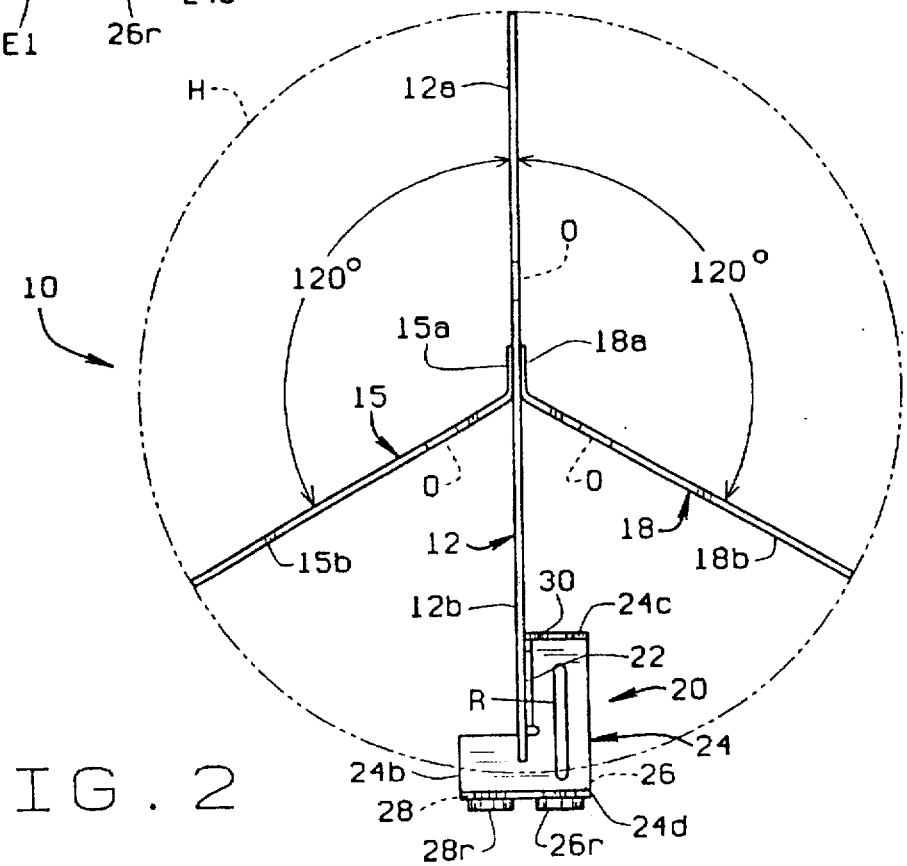
FIG. 2 is a top plan view of the assembly.
Figure 3:
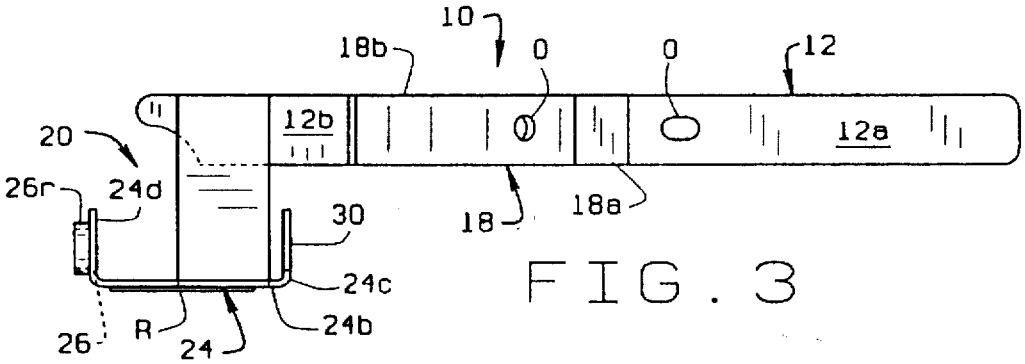
FIG. 3 is a side elevational view of the assembly.
Figure 4:
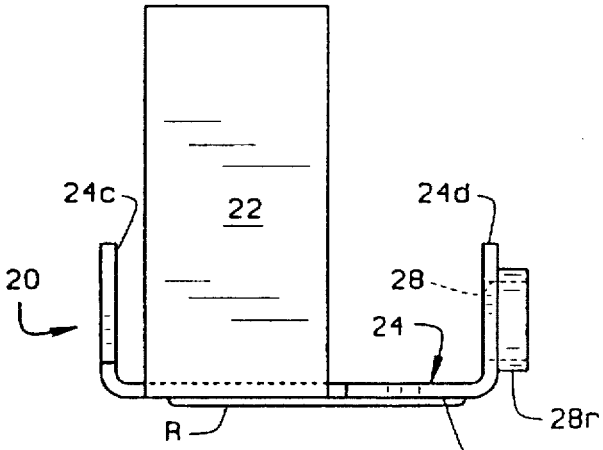
FIG. 4 is a side elevational view of a wiring support bracket of the assembly.
Figure 5:
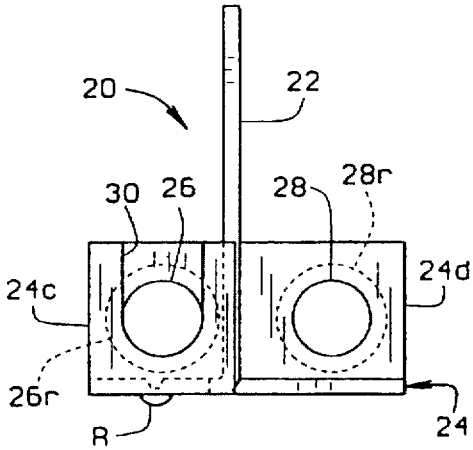
FIGS. 5 and 6 are respective end elevational views of the wiring support bracket.
Figure 6:
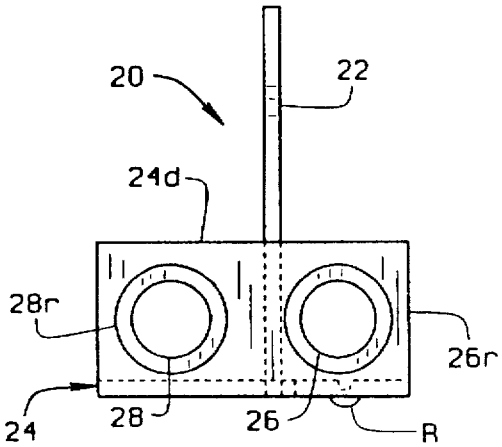
Figure 7:
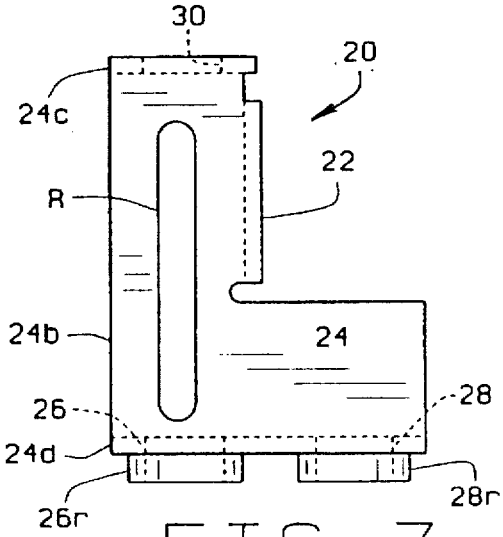
FIG. 7 is a bottom plan view of the wiring support bracket.

Referring to the drawings, a spider bracket 10 of the present invention is shown in FIG. 1 to support a spiral wound electrical heating element H. Heating element H has respective terminal ends E1, E2 by which the heating element is connected in an electrical circuit for current flow through the heating element. As is well-known in the art, the assembly comprised of the spider bracket and heating element is installed in a cook top (not shown). The spider bracket has three spider arms 12, 15, and 18 which support the heating element. Arm 12 extends completely across the assembly, the length of the arm generally corresponding to the diameter of the spiral wound heating element. The other arms are attached to arm 12 on opposite sides of the arm. Arms 15 and 18 each have a first section 15*a*, 18*a* respectively, which fits flat against arm 12. These sections are located on opposite sides of arm 12 at approximately the midpoint of the arm. Sections 15*a* and 18*a* are secured to arm 12 in any convenient manner; for example, by welding or riveting. The arms further have a second section 15*b*, 18*b* respectively, which angles outwardly from arm 12. As shown in FIG. 2, sections 15*b* and 18*b* of the spider arms extend radially outwardly at an angle measured from an end 12*a* of spider arm 12. While the angle shown in FIG. 2 is 120°, the angle may have a range of from 80°–150°. The length of each arm section 15*b*, 18*b* generally corresponds to the radius of the heater element. When formed as shown in the drawings, the top surfaces of the arms form a substantially planar surface upon which the heating element H is supported. In addition, each of the arms has an opening O formed in it for attaching a center medallion (not shown) of the heating element assembly.

Next, the spider bracket assembly includes an electrical wiring support bracket 20 to which the terminal ends E1, E2 of the heater element are attached. Wiring support bracket 20 includes a bracket arm 22 which is attached to an end 12*b* of spider arm 12. Bracket arm 22 is attached to end 12*b* of arm 12 in any convenient manner and depends from the spider arm. A terminal holding fixture 24 is integrally formed with the bracket arm so to comprise a one-piece wiring support structure with the bracket arm. Holding fixture 24 is formed at the base of the bracket arm and extends outwardly from the bracket arm at a 90° angle. The holding fixture is generally L-shaped, when viewed in plan, with the longitudinal axis of the longer leg of the L extending parallel to spider arm 12 when the holding fixture is mounted in place. The shorter leg of the L extends beneath end 12*b* of arm 12. As described hereinafter, one terminal end of the heater assembly extends parallel to arm 12 to one side of the arm; and the other terminal end extends parallel to the arm on the other side of the arm.

When viewed in elevation, holding fixture 24 is seen to be generally U-shaped including a base 24*b* and respective raised ends 24*c*, 24*d*. End 24*d* includes side-by-side, spaced apart apertures 26, 28 through which each of which a respective end of the heating element is inserted. A longitudinally extending strengthening rib R may be formed in base 24*b* of the holding fixture. As seen in FIG. 1, terminal end E1 fits through aperture 26, and terminal end E2 fits through aperture 28. Each aperture has a circumferential rim 26*r*, 28*r* respectively, which is formed on the outer face of end 24*d*. Each rim projects outwardly from the fixture and extends circumferentially about the aperture through which a terminal end projects. The rims are each deformable, by staking or swaging, for a portion of the rim to be pressed into contact with its associated terminal end of the heating element. This affixes the end of the heating element to the wiring support bracket and holds it in place. Opposite end 24*c* of the fixture includes a slot 30 in which terminal end E1 of the heating element is also inserted. The slot, which is axially aligned with aperture 26, is sized for the terminal end of the element to be fitted into the slot prior to insertion of the terminal end through aperture 26.

During assembly of the spider bracket, after the arms of the spider bracket are attached together and the wiring support bracket is installed, the heating element is installed. During this operation, terminal end E1 of the heating element is inserted through aperture 26 and the other terminal end E2 is inserted through aperture 28. At this time, the spider bracket assembly is positioned at a depending angle with respect to the heating element to facilitate this terminal end insertion. Once the terminals are fitted in apertures 26, 28, the spider bracket assembly is pivoted upwardly so the shielded portion of terminal end E1 is received in slot 30. Thereafter, by staking or swaging, respective rims 26*r*, 28*r* are deformed about the portion of the terminal ends extending through end 24*d* of the wiring support bracket to lock the ends in place. The sidewalls of end 24*c* in which slot 30 is formed are compressed about the sheath to further lock the terminal end E1 in place.

What has been described is a spider bracket assembly for use with an electrical heating element installed in a cook top. The assembly is available in different sizes to accommodate different sized heating elements used with various cook tops. The assembly defines a flat, planar surface for the heating element and maintains this surface when a pot or pan rests on the heating element. The assembly includes a wiring support bracket to which ends of the heating element are affixed and held in a desired position for connecting the heating element into an electrical circuit. The wiring support bracket is a unitary, integrally formed unit in which each end of the heating element is inserted in an aperture formed in the bracket to be supported in place. The terminal ends are affixed to the wiring support bracket by swaging or staking, and crimping of these ends until the assembly is eliminated. One of the ends of the heating element is further fitted into a second support formed in the bracket and spaced from the apertures. Finally, the spider bracket assembly is easy to assemble during manufacture, a heating element is readily installed on the completed assembly, and the terminal ends of the heating element are easily attached by the swaging or staking operation.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. A spider bracket supporting an electrical heating element having respective first and second terminal ends adapted for connection in an electrical circuitry by which current flows through the heating element comprising:

a plurality of spider arms supporting the heating element; and, support means to which said terminal ends of the heating element are affixed, said support means including a bracket arm attached to one of said spider arms and extending therefrom and holding means connected to said bracket arm, said holding means including a longitudinally extending strengthening rib and separate aperture through which each of said terminal ends is inserted with each said aperture having a circumferential rim projecting outwardly from a portion of said holding means in which said apertures are formed and extending circumferentially about said aperture, each said rim being deformable such that a portion of said rim is pressed into an associated terminal end of said heating element during a staking operation to affix said end of said heating element to said support means.

2. The spider bracket of claim 1 wherein said holding means further includes a support arm in which a slot is formed with one of said terminal ends also being received in said slot.

3. The spider bracket of claim 2 wherein said holding means comprises a support fixture having a base plate connected with said bracket arm and depending therefrom when said bracket arm is connected to said spider arm, and a first and inner raised end and a second and outer raised end formed at respective ends of said base plate.

4. The spider bracket of claim 3 wherein said support arm in which said slot is formed comprises said inner support arm.

5. The spider bracket of claim 4 wherein said apertures are formed in said second support arm in a side-by side arrangement, and said slot in said inner support arm and said aperture in said outer support arm through both of which said one terminal end of said heating element is inserted being axially aligned with each other.

6. The spider bracket of claim 1 including three spider arms, each of said spider arms having at least one opening therein configured for attachment of a center medallion.

7. The spider bracket of claim 6 wherein said heating element is a spiral wound heating element and one of said spider arms extends across a diameter of the heating element.

8. The spider bracket of claim 7 wherein said support means is connected to said one spider arm adjacent one end thereof.

9. The spider bracket of claim 8 wherein each of the other spider arms is attached to said one spider arm and extends radially outwardly therefrom, the length each of said spider arms extends corresponding to a radius of the heating element.

10. The spider bracket of claim 9 wherein each of said other spider arms attach to opposite sides of said one spider arm at a middle portion of said one spider arm.

11. The spider bracket of claim 10 wherein each of said other spider arms extends radially outwardly at a predetermined angle measured from the end of said one spider arm opposite the end to which said holding means to said one spider arm.

12. A spider bracket supporting a spiral wound electrical heating element having respective first and second terminal ends adapted for connection in an electrical circuitry by which current flows through the heating element comprising:

a plurality of spider arms supporting the heating element, a first of said spider arms extending across a diameter of the heating element and including a pair of openings therein configured for attachment of a center medallion, and a second and third spider arm each being attached to said first spider arm and extending radially outwardly therefrom, each including an opening therein configured for attachment of said center medallion, the length said second and third spider arms extend corresponding to a radius of the heating element; and support means to which said terminal ends of the heating element are affixed, said support means including a bracket arm attached to one end of said first spider arm and depending therebeneath, and a wiring support fixture connected to said bracket arm, said wiring support bracket having a longitudinally extending strengthening rib, and a pair of apertures located at one end thereof through which with one of said terminal ends being inserted through each respective aperture, said apertures each having a circumferential rim projecting outwardly from said end of said wiring support fixture and extending circumferentially about said aperture, each said rim being deformable such that a portion of said rim is pressed into an associated terminal end of said heating element during a swaging operation to affix said end of said heating element to said support means.

13. The spider bracket of claim 12 wherein said wiring support fixture includes a base plate connected with said bracket arm, and support arms formed at each of said base plate, said apertures being formed in a side-by-side arrangement in one of the support arms, and the other support arm having a slot formed therein in which one of said terminal ends of said heating element is also received.

14. The spider bracket of claim 13 wherein said slot in said inner support arm and said aperture in said outer support arm through both of which said one terminal end of said heating element is inserted are axially aligned with each other.

15. The spider bracket of claim 14 wherein said second and third spider arms attach to opposite sides of said first spider arm at the middle thereof, and said second and third spider arms extend radially outwardly at a predetermined angle measured from the end of said first spider arm opposite the end to which said wiring support bracket is attached to said first spider arm.

16. The spider bracket of claim 15 wherein said said predetermined angle is between 80°–150°.

* * * * *